US008733897B2

(12) United States Patent
Okamura

(10) Patent No.: US 8,733,897 B2
(45) Date of Patent: May 27, 2014

(54) NON-WETTING COATING ON A FLUID EJECTOR

(75) Inventor: Yoshimasa Okamura, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 434 days.

(21) Appl. No.: 13/125,474

(22) PCT Filed: Oct. 27, 2009

(86) PCT No.: PCT/US2009/062194

§ 371 (c)(1),
(2), (4) Date: Jul. 18, 2011

(87) PCT Pub. No.: WO2010/051272

PCT Pub. Date: May 6, 2010

(65) Prior Publication Data

US 2011/0261112 A1 Oct. 27, 2011

Related U.S. Application Data

(60) Provisional application No. 61/109,754, filed on Oct. 30, 2008.

(51) Int. Cl.
*B41J 2/135* (2006.01)
*B05D 1/38* (2006.01)

(52) U.S. Cl.
USPC ..... 347/45

(58) Field of Classification Search
USPC ..... 347/29, 40, 44–47, 49, 64, 67, 71, 347/86–87, 108; 427/535
See application file for complete search history.

(56) References Cited

U.S. PATENT DOCUMENTS 5,121,134 A 6/1992 Albinson et al.
5,595,785 A 1/1997 Hindagolla et al.

(Continued)

FOREIGN PATENT DOCUMENTS

EP 0972640 1/2000
EP 1108761 6/2001

(Continued)

OTHER PUBLICATIONS

Extended European Search Report dated Aug. 2, 2012 issued in European application No. 09824066.6, 13 pgs.

(Continued)

*Primary Examiner* — Thinh Nguyen
(74) *Attorney, Agent, or Firm* — Fish & Richardson P.C.

(57) ABSTRACT

A fluid ejector includes a substrate having an exterior surface and an interior surface. A non-wetting coating can cover at least a portion of the exterior surface and can be substantially absent from the flow path. A non-wetting coating can be formed of a molecular aggregation. A precursor of a non-wetting coating may flow into a chamber at a higher temperature higher than the substrate. A non-wetting coating can be over a seed layer. An outer portion of the seed layer can have a higher concentration of water molecules or a greater density than an inner portion. The outer portion can be deposited at a ratio of partial pressure water to partial pressure matrix precursor that is higher than the ratio for the inner portion. An oxygen plasma can be applied to a seed layer on the exterior surface, and the non-wetting coating can be applied on the seed layer.

14 Claims, 5 Drawing Sheets

(56) References Cited

U.S. PATENT DOCUMENTS

| | | | | |
|---|---|---|---|---|
| 5,606,352 | A | 2/1997 | Yamakawa et al. | |
| 5,781,213 | A | 7/1998 | Ujita et al. | |
| 5,812,158 | A | 9/1998 | Murthy et al. | |
| 5,910,372 | A | 6/1999 | Griffin et al. | |
| 5,959,643 | A | 9/1999 | Temple et al. | |
| 6,283,578 | B1 | 9/2001 | Popall et al. | |
| 6,312,103 | B1 | 11/2001 | Haluzak | |
| 6,325,490 | B1 | 12/2001 | Yang et al. | |
| 6,364,456 | B1 | 4/2002 | Yang et al. | |
| 6,416,159 | B1 | 7/2002 | Floyd et al. | |
| 6,428,142 | B1 | 8/2002 | Silverbrook et al. | |
| 6,472,332 | B1 | 10/2002 | Gooray et al. | |
| 6,488,357 | B2 | 12/2002 | Skinner et al. | |
| 6,561,624 | B1 | 5/2003 | Kikugawa et al. | |
| 6,676,244 | B2 | 1/2004 | Kwon et al. | |
| 6,827,973 | B2 | 12/2004 | Nagashima | |
| 6,938,986 | B2 | 9/2005 | Macler et al. | |
| 6,972,261 | B2 | 12/2005 | Wong et al. | |
| 7,104,632 | B2 | 9/2006 | Song et al. | |
| 7,347,532 | B2 | 3/2008 | Chen et al. | |
| 7,622,048 | B2 | 11/2009 | Birkmeyer et al. | |
| 8,128,201 | B2 * | 3/2012 | Okamura et al. | 347/45 |
| 2003/0030697 | A1 | 2/2003 | Kwon et al. | |
| 2003/0042545 | A1 | 3/2003 | Voutsas et al. | |
| 2003/0197758 | A1 | 10/2003 | Sasaki et al. | |
| 2004/0002225 | A1 | 1/2004 | Wong et al. | |
| 2004/0125169 | A1 | 7/2004 | Nakagawa et al. | |
| 2005/0046663 | A1 | 3/2005 | Silverbrook | |
| 2006/0057851 | A1 | 3/2006 | Wong et al. | |
| 2007/0030306 | A1 | 2/2007 | Okamura et al. | |
| 2007/0216726 | A1 | 9/2007 | Shimura et al. | |
| 2008/0136866 | A1 | 6/2008 | Okamura et al. | |
| 2008/0150998 | A1 | 6/2008 | Okamura | |
| 2011/0063369 | A1 | 3/2011 | Okamura | |
| 2011/0212261 | A1 | 9/2011 | Okamura et al. | |

FOREIGN PATENT DOCUMENTS

| | | | |
|---|---|---|---|
| EP | 1 157 842 | A1 | 11/2001 |
| EP | 1 375 154 | A2 | 1/2004 |
| EP | 1 568 500 | A1 | 8/2005 |
| JP | 9085956 | | 3/1997 |
| JP | 10235858 | | 9/1998 |
| WO | WO 03/013863 | A1 | 2/2003 |
| WO | 2005007411 | | 1/2005 |
| WO | 2005007413 | | 1/2005 |
| WO | WO 2005/037558 | A2 | 4/2005 |
| WO | 2007/005857 | | 1/2007 |
| WO | 2010/051272 | | 5/2010 |

OTHER PUBLICATIONS

Ashurst, et al., "Vapor Phase Anti-Stiction Coatings for MEMS", IEEE Transactions on Device and Materials Reliability, vol. 3, No. 4, Dec. 2003, pp. 173-178.

Kobrin, et al., "Molecular Vapor Deposition—An Improved Vapor-Phase Deposition Technique of Molecular Coatings for MEMS Devices", SEMI® Technical Symposium: Innovations in Semiconductor Manufacturing, Semicon West 2004, pp. 1-4.

Ashurst, et al., "Dichlorodimethylsilane as an Anti-Stiction Monolayer for MEMS: A Comparison to the Octadecyltrichlosilane Self-Assembled Monolayer", Journal of Microelectromechanical Systems, vol. 10, No. 1, Mar. 2001, pp. 41-49.

Applied MicroStructures, Inc., "Common Precursors Used in MEMS", 2004, pp. 1-2.

Bunker et al., "The Impact of Solution Agglomeration on the Deposition of Self-Assembled Monolayers," Sandia National Laboratories, Received Apr. 4, 2000, Published on the Web Aug. 26, 2000, pp. 7742-7751.

International Search Report and Written Opinion dated Jan. 4, 2010 issued in international application No. PCT/US2009/062194, 11 pgs.

Office action dated Jan. 2, 2013 issued in corresponding Korean application No. 10-2011-7008856.

* cited by examiner

NON-WETTING COATING ON A FLUID EJECTOR

CROSS-REFERENCE TO RELATED APPLICATIONS

This application is the national stage of International Application Number PCT/US2009/062194, entitled "NON-WETTING COATING ON A FLUID EJECTOR", filed on Oct. 27, 2009, which is based on and claims the benefit of the filing date of U.S. Provisional Application No. 61/109,754, entitled "NON-WETTING COATING ON A FLUID EJECTOR", filed on Oct. 30, 2008.

TECHNICAL FIELD

This description relates to coatings on fluid ejectors.

BACKGROUND

A fluid ejector (e.g., an ink jet printhead) typically has an interior surface, an orifice through which fluid is ejected, and an exterior surface. When fluid is ejected from the orifice, the fluid can accumulate on the exterior surface of the fluid ejector. When fluid accumulates on the exterior surface adjacent to the orifice, further fluid ejected from the orifice can be diverted from an intended path of travel or blocked entirely by interaction with the accumulated fluid (e.g., due to surface tension).

Non-wetting coatings such as Teflon® and fluorocarbon polymers can be used to coat surfaces. However, Teflon® and fluorocarbon polymers typically are soft and are not durable coatings. These coatings also can be expensive and difficult to pattern.

SUMMARY

In one aspect, a fluid ejector includes a substrate having an exterior surface and an interior surface defining a flow path for fluid to an orifice in the exterior surface, and a non-wetting coating covering at least a portion of the exterior surface and substantially absent from the flow path. The non-wetting coating is formed of a molecular aggregation.

Implementations may include one or more of the following. An inorganic seed layer of different composition than the substrate may cover the interior surface and the exterior surface of the substrate, and the non-wetting coating may be disposed directly on the seed layer. The substrate may be formed of single crystal silicon and the seed layer may be silicon oxide. The non-wetting coating may be disposed directly on the substrate. The non-wetting coating includes molecules that have a carbon chain terminated at one end with a $CF_3$ group. The non-wetting coating may include molecules formed from at least one precursor from the group consisting of tridecafluoro 1,1,2,2 tetrahydrooctyltrichlorosilane (FOTS) and 1H,1H,2H,2H perfluorodecyl-trichlorosilane (FDTS). The non-wetting coating may have a thickness between 50 and 1000 Angstroms. The non-wetting coating may include a plurality of identical molecules held in the molecular aggregation substantially by intermolecular forces and substantially without chemical bonds.

In another aspect, a method of forming a non-wetting coating on a fluid ejector includes holding a fluid ejector in a chamber at a first temperature, and flowing a precursor of the non-wetting coating into the chamber at a second temperature higher than the first temperature.

Implementations may include one or more of the following. A support in the chamber for holding the fluid ejector may be maintained at a lower temperature than a gas manifold for supplying the precursor gasses to the chamber. A temperature difference between the support and the gas manifold may be at least 70° C. The support may be cooled below room temperature and the gas manifold may be maintained at room temperature or higher. The support may be maintained at room temperature and the gas manifold may be heated above room temperature. The precursor may include at least of tridecafluoro 1,1,2,2 tetrahydrooctyltrichlorosilane (FOTS) or 1H,1H,2H,2H perfluorodecyl-trichlorosilane (FDTS). The non-wetting coating may be removed from an interior surface of the fluid ejector that defines a flow path for fluid ejection.

In another aspect, a fluid ejector includes a substrate having an exterior surface and an interior surface defining a flow path for fluid to an orifice in the exterior surface, a seed layer of different composition than the substrate coating at least the exterior surface of the substrate, and a non-wetting coating over the seed layer and covering at least a portion of the exterior surface and substantially absent from the flow path. The seed layer includes water molecules trapped in an inorganic matrix, and the seed layer includes an inner portion and an outer portion farther from the substrate than the inner portion, the outer portion having a higher concentration of water molecules than the inner portion.

Implementations may include one or more of the following. The seed layer may have a total thickness up to about 200 nm. The outer portion may have a thickness between about 50 and 500 Angstroms. The matrix of the seed layer may be an inorganic oxide. The inorganic oxide may be silicon dioxide. The non-wetting coating may include a siloxane bonded to the silicon dioxide. The seed layer may coat the inner surface.

In another aspect, a method of forming a non-wetting coating on a fluid ejector includes depositing a seed layer on an exterior surface of a substrate, the seed layer including water molecules trapped in an inorganic matrix, and depositing a non-wetting coating on the seed layer. Depositing the layer includes depositing an inner portion of the seed layer on the substrate at a first ratio of partial pressure water to partial pressure matrix precursor, and depositing an outer portion of the seed layer on the inner portion at a second ratio of partial pressure water to partial pressure matrix precursor that is higher than the first ratio.

Implementations may include one or more of the following. The inorganic matrix may be silicon dioxide. The substrate may be single-crystal silicon. The non-wetting coating may include a siloxane chemically bonded to the seed layer. The matrix precursor may includes $SiCl_4$. The first ratio $H_2O$:$SiCl_4$ may be less than 2:1. The second ratio $H_2O$:$SiCl_4$ may be more than 2:1. The outer portion may have a thickness of between about 50 and 500 Angstroms.

In another aspect, a fluid ejector includes a substrate having an exterior surface and an interior surface defining a flow path for fluid to an orifice in the exterior surface, a seed layer of different composition than the substrate coating at least a portion of the exterior surface of the substrate, and a non-wetting coating over the seed layer and covering at least a portion of the exterior surface and substantially absent from the flow path. The seed layer includes an inner portion with a first density and an outer portion farther from the substrate than the inner portion, the outer portion having a second density greater than the first density.

Implementations may include one or more of the following. The seed layer may include silicon dioxide. The substrate may be single-crystal silicon. The non-wetting coating may include a siloxane chemically bonded to the seed layer. The first density may be about 2.0 g/cm$^3$. The second density may be at least 2.4 g/cm$^3$, e.g., about 2.7 g/cm$^3$. The second density may be at least about 0.3 g/cm$^3$ greater than the first density. The outer portion may have a thickness of about 40 Angstroms.

In another aspect, a method of forming a non-wetting coating on a fluid ejector includes depositing a seed layer on an exterior surface of a substrate, applying an oxygen plasma to the seed layer on the exterior surface, and depositing a non-wetting coating on the seed layer on the exterior surface.

Implementations may include one or more of the following. The seed layer may be deposited on an interior surface of the substrate that defines a flow path for fluid to an orifice in the exterior surface. The non-wetting coating may be deposited on the interior surface. The non-wetting coating on the interior surface may be removed. The seed layer may include silicon dioxide. The substrate may be single-crystal silicon. The non-wetting coating may include a siloxane that chemically bonds to the seed layer. At least a portion of the seed layer may be deposited at a ratio of partial pressure water to partial pressure matrix precursor that is greater than the ratio of water matrix consumed in the chemical reaction forming the silicon oxide. The matrix precursor may includes $SiCl_4$. The ratio of partial pressure water to partial pressure matrix precursor may be more than 2:1.

Certain implementations may have one or more of the following advantages. The exterior surfaces surrounding the orifice may be non-wetting, and interior surfaces that contact fluid to be ejected may be wetting. The non-wetting coating may reduce the accumulation of fluid on the exterior surface of the fluid ejector, and may thereby improve reliability of the fluid ejector. The non-wetting coating may be denser, which may make it more durable and insoluble to a wider range of fluids. A seed layer below the non-wetting coating may be denser, which may make it more durable and insoluble to wider range of fluids. The non-wetting coating may be thicker, and thus durability of the non-wetting coating can be improved. An overcoat layer may cover an interior surface of the fluid ejector. A highly wetting overcoat layer on surfaces contacting fluid to be ejected may enable improved control over droplet size, rate of ejection, and other fluid ejection properties.

DETAILED DESCRIPTION

Figure 1A:
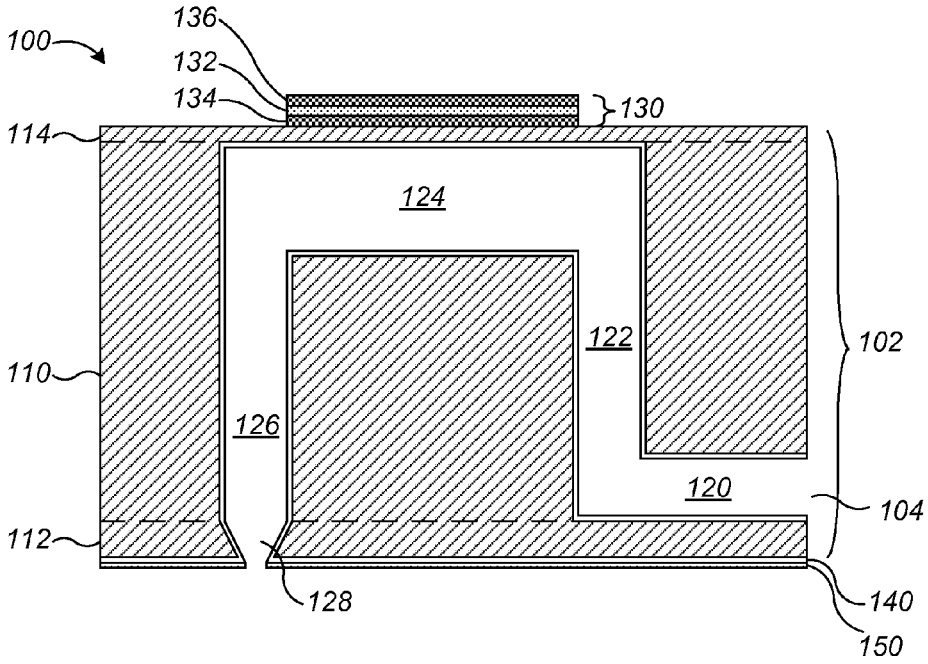
FIG. 1A is a cross-sectional view of an exemplary fluid ejector.

FIG. 1A is a cross-sectional view of an fluid ejector 100 (e.g., an ink jet printhead nozzle), aspects of which not discussed herein can be implemented as described in U.S. Patent Publication No. 2008-0020573, the contents of which are hereby incorporated by reference.

The fluid ejector 100 includes a substrate 102 that has a fluid flow path 104 formed therein. The substrate 102 can include a flow-path body 110, a nozzle layer 112 and a membrane layer 114. The fluid flow path 104 can include a fluid inlet 120, an ascender 122, a pumping chamber 124 adjacent the membrane layer 114, a descender 126 and a nozzle 128 formed through the nozzle layer 112. The flow-path body 110, nozzle layer 112 and membrane layer 114 can each be silicon, e.g., single crystal silicon. In some implementations, the flow-path body 110, nozzle layer 112 and membrane layer 114 are fusion or silicon-to-silicon bonded to each other. In some implementations, the flow-path module 110 and the nozzle layer 112 are part of a monolithic body.

An actuator 130 is positioned on the membrane layer 114 over the pumping chamber 124. The actuator 130 can include a piezoelectric layer 132, a lower electrode 134 (e.g., a ground electrode), and an upper electrode 136 (e.g., a drive electrode). In operation the actuator 130 causes the membrane 114 over the pumping chamber 124 to deflect, pressurizing liquid (e.g., an ink, for example, a water-based ink) in the pumping chamber 124, and causing the liquid to flow through the descender 126 and be ejected through the nozzle 128 in the nozzle layer 112.

Figure 1B:
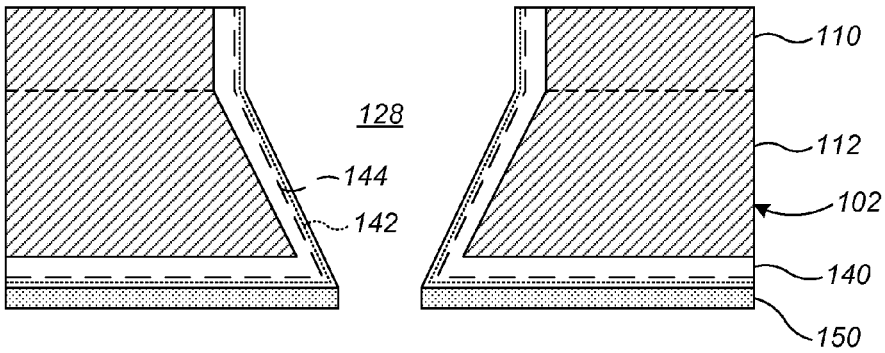
FIG. 1B is an expanded view of the nozzle of the fluid ejector of FIG. 1A.

An inorganic seed layer 140 covers the outer surface of the nozzle layer 112 and the interior surfaces of the substrate 102 that define the flow-path 110. Inorganic layer 140 may be formed of a material, e.g. an inorganic oxide, e.g., silicon oxide ($SiO_2$), that promotes adhesion of silane or siloxane coatings. The oxide layer can be between about 5 nm and about 200 nm thick. Optionally, as shown in FIG. 1B, an outer portion 142 of the inorganic layer 140 can have a higher density than the remainder of the inorganic layer 140. For example, the outer portion 142 can have a density of 2.4 g/cm$^3$ or more (e.g., 2.7 g/cm$^3$), whereas the inner portion can have a density of about 2.0 g/cm$^3$. The outer portion 142 can have a thickness of no more than about 60 Angstroms, e.g., a thickness of about 40 Angstroms. The increased density of the outer portion of the seed can make it more durable and insoluble to a wider range of fluids. Alternatively, the inorganic layer 140 can have substantially the same density throughout.

Optionally, as shown in FIG. 1B, an outer portion 144 of the inorganic layer 140 can have a higher concentration of water trapped therein than the remainder of the inorganic layer 140. The outer portion 144 can have a thickness of about 50 to 500 Angstroms. The increased water concentration can result in a higher concentration of —OH groups at the surface of the inorganic layer 140, which can provide a higher concentration of attachment points for molecules of the non-wetting coating, which can produce a higher density in the non-wetting coating. However, the higher concentration of —OH groups at the surface of the inorganic layer 140 can also make the inorganic layer itself less chemically resistant. Alternatively, the inorganic layer 144 can have substantially the same water concentration throughout.

The outer portion 144 of high-water-concentration and the outer portion 142 of high density can be present individually or in combination.

Figure 2A:
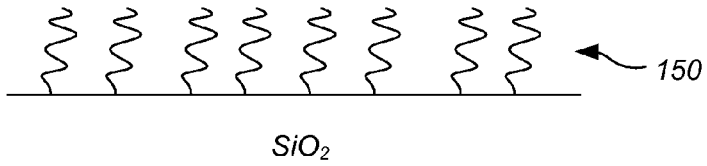
FIG. 2A is a schematic view of a non-wetting coating monolayer.
Figure 2B:
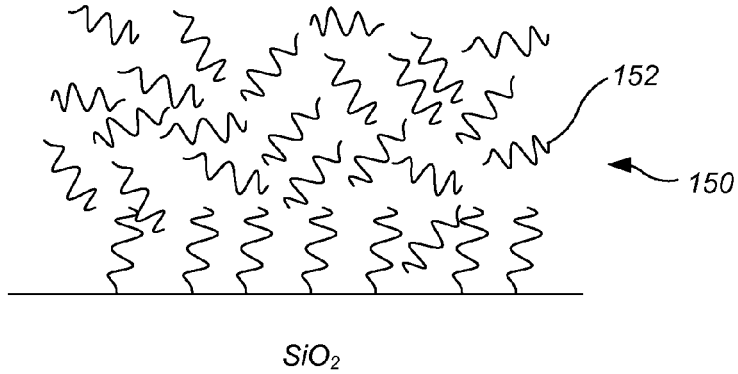
FIG. 2B is a schematic view of a non-wetting coating aggregation.

A non-wetting coating 150, e.g., a layer of hydrophobic material, covers the inorganic layer 140 on the exterior surface of the fluid ejector 100, e.g., the non-wetting coating is not present in the flow-path 104. As illustrated by FIG. 2A, the non-wetting coating 150 can a self-assembled monolayer, i.e., a single molecular layer. Such a non-wetting coating monolayer 150 can have a thickness of about 10 to 20 Angstroms, e.g., about 15 Angstroms. Alternatively, as illustrated by FIG. 2B, the non-wetting coating 150 can be a molecular aggregation. In a molecular aggregation, the molecules 152 are separate but held in the aggregation by intermolecular forces, e.g., by hydrogen bonds and/or Van der Waals forces, rather than ionic or covalent chemical bonds. Such a non-wetting coating aggregation 150 can have a thickness of about 50 to 1000 Angstroms. The increased thickness of the non-wetting coating make the non-wetting coating more durable and resistant to a wider range of fluids.

The molecules of the non-wetting coating can include one or more carbon chains terminated at one end with a —$CF_3$ group. The other end of the carbon chain can be terminated with a $SiCl_3$ group, or, if the molecule is bonded to a silicon oxide layer 140, terminated with a Si atom which is bonded to an oxygen atom of the silicon oxide layer (the remaining bonds of the Si atom can be filled with oxygen atoms that are connected in turn to the terminal Si atoms of adjacent non-wetting coating molecules, or with OH groups, or both. In general, the higher the density of the non-wetting coating, the lower the concentration of such OH groups). The carbon chains can be fully saturated or partially unsaturated. For some of the carbon atoms in the chain, the hydrogen atoms can be replaced by fluorine. The number of carbons in the chain can be between 3 and 10. For example, the carbon chain could be $(CH_2)_M(CF_2)_NCF_3$, where M≥2 and N≥0, and M+N≥2, e.g., $(CH_2)_2(CF_2)_7CF_3$.

Figure 2C:
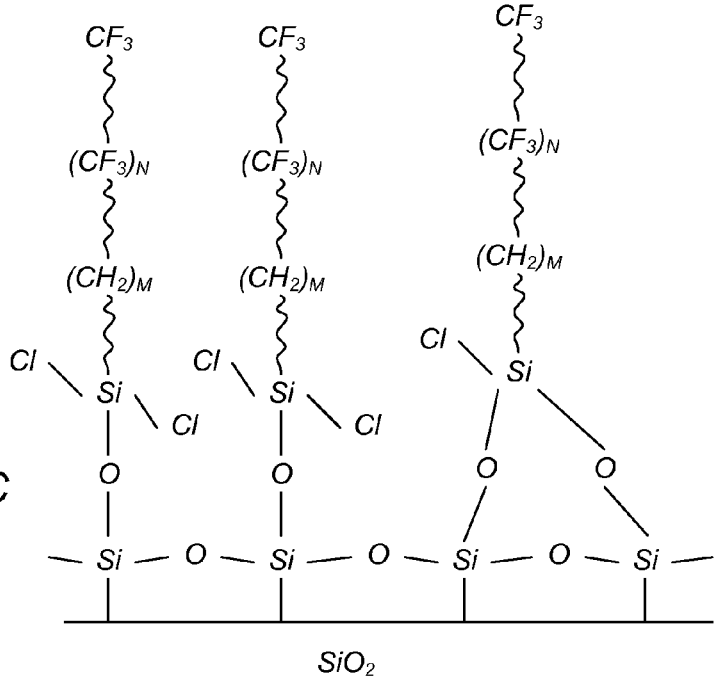
FIG. 2C is a schematic diagram of a chemical structure of an exemplary molecule of a non-wetting coating.

Referring to FIG. 2C, the molecules of the non-wetting coating adjacent the substrate 102, i.e., the monolayer or the portion of the molecular aggregation adjacent the substrate, can be a siloxane that forms a bond with the silicon oxide of the inorganic layer 140.

Figure 3A:
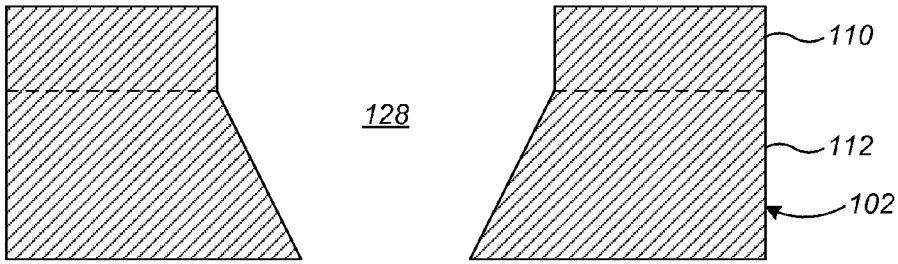
FIGS. 3A-3G illustrate an exemplary process for forming a fluid ejector.

A process for forming the non-wetting coating on a fluid ejector (e.g., an ink jet printhead nozzle) begins, as shown FIG. 3A, with an uncoated substrate 102. The uncoated substrate 102 can be formed of single-crystal silicon. In some implementations, a native oxide layer (a native oxide typically has a thickness of 1 to 3 nm) is already present on the surfaces of the substrate 102.

The surfaces to be coated by the inorganic seed layer 140 can be cleaned prior to coating by, for example, applying an oxygen plasma. In this process, an inductively coupled plasma (ICP) source is used to generate active oxygen radicals which etch organic materials, resulting in a clean oxide surface.

Figure 3B:
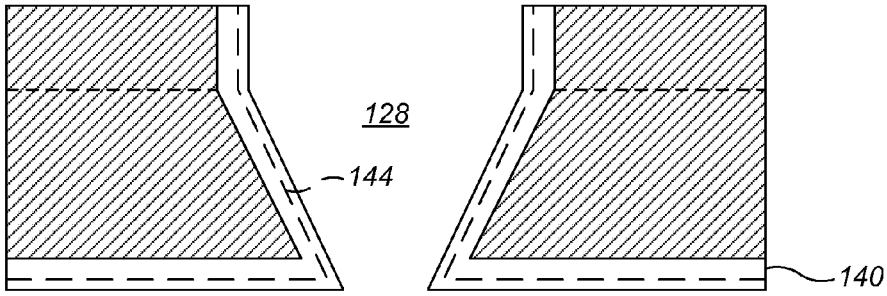

As shown in FIG. 3B, the inorganic seed layer 140 is deposited on exposed surfaces of the fluid ejector, e.g. outer the nozzle layer 112 and the fluid flow path 104, including the interior and exterior surfaces. An inorganic seed layer 140 of $SiO_2$ can be formed on exposed surfaces of nozzle layer 112 and flow-path module 104 by introducing $SiCl_4$ and water vapor into a chemical vapor deposition (CVD) reactor containing the uncoated fluid ejector 100. A valve between the CVD chamber and a vacuum pump is closed after pumping down the chamber, and vapors of $SiCl_4$ and $H_2O$ are introduced into the chamber. The partial pressure of the $SiCl_4$ can be between 0.05 and 40 Torr (e.g., 0.1 to 5 Torr), and the partial pressure of the $H_2O$ can be between 0.05 and 20 Torr (e.g., 0.2 to 10 Torr). Seed layer 140 may be deposited on a substrate that is heated to a temperature between about room temperature and about 100° C. For example, the substrate might not be heated, but the CVD chamber can be at 35° C.

In some implementations of the CVD fabrication process, the seed layer 140 is deposited in a two-step process in which the ratios of partial pressure of $H_2O$ to partial pressure of $SiCl_4$ are different. In particular, in the second step that disposes the outer portion 144 of the seed layer, the partial pressure ratio of $H_2O$:$SiCl_4$ can be higher than the ratio in the first step that disposes the portion of the seed layer closer to the substrate 102. The first step can be performed at a higher partial pressure of $H_2O$: than the second step. In some implementations, in the first step the partial pressure ratio of $H_2O$:$SiCl_4$ can be less than 2:1, e.g., about 1:1, whereas in the second step the partial pressure ratio of $H_2O$:$SiCl_4$ can be 2:1 or more, e.g., 2:1 to 3:1. For example, the partial pressure of $SiCl_4$ can be about 2 Torr in both steps, and the partial pressure of $H_2O$ can be about 2 Torr in the first step and about 4-6 Torr in the second step. The second step can be conducted with sufficient duration so that the outer portion 144 has a thickness of about 50 to 500 Angstroms.

Without being limited to any particular theory, by performing the second deposition step at a higher partial pressure ratio of $H_2O$:$SiCl_4$, a higher concentration of $H_2O$ is trapped in the $SiO_2$ matrix in the outer portion 144. As a result, a higher concentration of —OH groups can be present at the surface of the inorganic layer 140.

Alternatively or in addition to performing the second deposition step at a higher partial pressure ratio of $H_2O$:$SiCl_4$, the second deposition step can be performed at a lower substrate temperature than the first step. For example, the first deposition step can be performed with the substrate at about 50-60° C., and the second deposition step at about 35° C. Without being limited to any particular theory, performing the second deposition step at a lower temperature should also increase the concentration of —OH groups present at the surface of the inorganic layer 140.

In some implementations of the fabrication process, the entire seed layer 140 can be deposited in a single continuous step without varying the temperature or the higher partial pressure ratio of $H_2O$:$SiCl_4$. Again without being limited to any particular theory, this can result in the concentration of $H_2O$ that is trapped in the $SiO_2$ matrix being more uniform through the seed layer 140.

The total thickness of the inorganic seed layer 140 can be between about 5 nm and about 200 nm. For some fluids to be ejected, the performance can be affected by the thickness of the inorganic layer. For example, for some "difficult" fluids, a thicker layer, e.g., 30 nm or more, such as 40 nm or more, e.g., 50 nm or more, will provide improved performance. Such "difficult" fluids can include, for example, various conducting polymers and light emitting polymers, e.g., poly-3,4-ethylenedioxythiophene (PEDOT), or a light emitting polymer, such as DOW Green K2, from Dow Chemical, as well as chemically "aggressive" inks, such as inks including "aggressive" pigments and/or dispersants.

Next, the fluid ejector can be subjected to an oxygen $O_2$ plasma treatment step. In particular, both the inner and outer surfaces of the inorganic seed layer 140 are exposed to the $O_2$ plasma. The oxygen plasma treatment can be conducted, for example, in anode coupling plasma tool from Yield Engineering Systems with an $O_2$ flow rate of 80 sccm, a pressure of 0.2 Torr, an RF Power of 500 W, and a treatment time of five minutes.

Figure 3C:
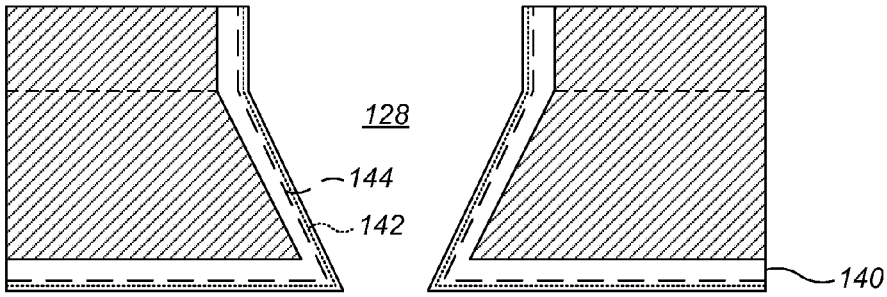

Referring to FIG. 3C, the $O_2$ plasma treatment can densify the outer portion 142 of the silicon oxide seed layer 140. For example, the outer portion 142 can have a density of 2.4 g/cm$^3$ or more, whereas the lower portions of the seed layer 140 can have a density of about 2.0 g/cm$^3$. In addition, the $O_2$ plasma treatment can be even more effective at densification if the outer portion, e.g., outer portion 144, was deposited at a "high" partial pressure ratio of $H_2O$:$SiCl_4$, e.g., at a pressure ratio of $H_2O$:$SiCl_4$ greater than 2:1. In such a case, the outer portion 142 can have a density of about 2.7 g/cm$^3$. The outer portion 142 can have a thickness of about 40 Angstroms.

Figure 3D:
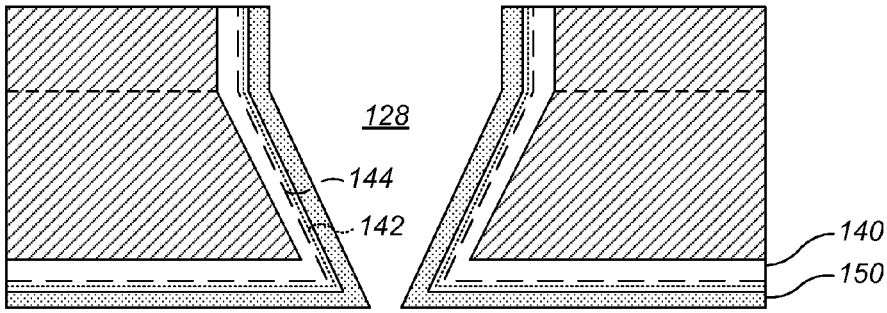

Next, as shown in FIG. 3D, the non-wetting coating 150, e.g., a layer of hydrophobic material, is deposited on exposed surfaces of the fluid ejector, including both the outer surface and the inner surface of the flow path 104. The non-wetting coating 150 can be deposited using vapor deposition, rather than being brushed, rolled, or spun on.

The non-wetting coating 150 can be deposited, for example, by introducing a precursor and water vapor into the CVD reactor at a low pressure. The partial pressure of the precursor can be between 0.05 and 1 Torr (e.g., 0.1 to 0.5 Torr), and the partial pressure of the $H_2O$ can be between 0.05 and 20 Torr (e.g., 0.1 to 2 Torr). The deposition temperature can be between room temperature and about 100 degrees centigrade. The coating process and the formation of the inorganic seed layer 140 can be performed, by way of example, using a Molecular Vapor Deposition (MVD)™ machine from Applied MicroStructures, Inc.

Suitable precursors for the non-wetting coating 150 include, by way of example, precursors containing molecules that include a terminus that is non-wetting, and a terminus that can attach to a surface of the fluid ejector. For example, precursor molecules that include a carbon chain terminated at one end with a —$CF_3$ group and at a second end with an —$SiCl_3$ group can be used. Specific examples of suitable precursors that attach to silicon surfaces include tridecafluoro-1,1,2,2-tetrahydrooctyltrichlorosilane (FOTS) and 1H,1H,2H,2H-perfluorodecyl-trichlorosilane (FDTS). Other examples of non-wetting coatings include 3,3,3-trifluoropropyltrichlorosilane ($CF_3(CH_2)_2SiCl_3$) and 3,3,3,4,4,5,5,6,6,-nonafluorohexyltrichlorosilane ($CF_3(CF_2)_3(CH_2)_2SiCl_3$). Without being limited by any particular theory, it is believed that when a precursor (such as FOTS or FDTS) whose molecules include an —$SiCl_3$ terminus are introduced into the CVD reactor with water vapor, the precursor undergoes hydrolysis, and then a siloxane bond is created so that silicon atoms from the —$SiCl_3$ groups bond with oxygen atoms from —OH groups on the inorganic layer 165, resulting in a coating, such as a monolayer, of molecules with the other, i.e. non-wetting, terminus exposed.

In some implementations, the non-wetting coating 150 forms a self-assembled monolayer, i.e., a single molecular layer. Such a non-wetting coating monolayer 150 can have a thickness of about 10 to 20 Angstroms, e.g., about 15 Angstroms.

In some implementations, the non-wetting coating 150 forms a molecular aggregation, e.g., an aggregation of fluorocarbon molecules. Such a non-wetting coating aggregation 150 can have a thickness of about 50 to 1000 Angstroms. To form the non-wetting coating aggregation, the temperature of the substrate is set to be lower than the temperature of the non-wetting coating precursors. Without being limited to any particular theory, the lower temperature of the substrate effectively causing condensation of the fluorocarbon on the seed layer 140. This can be accomplished by making the substrate support a lower temperature than the gas manifold, e.g., the lines or supply cylinders, for the gasses used to deposit the non-wetting coating. The temperature difference between the substrate support and the gas manifold (and possibly between the substrate itself and the gasses entering the chamber) can be about 70° C. For example, the substrate support can be cooled by liquid nitrogen, so that the substrate support is at about −194° C., while the gas manifold is at room temperature, e.g., about 33° C. As another example, the substrate support can be cooled by a chiller, so that the substrate support is at about −40° C., while the gas manifold is at room temperature, e.g., about 33° C. As another example, the substrate support is maintained at about room temperature, e.g., about 33° C., and the gas manifold is heated, e.g., to about 110° C.

The molecular aggregation can be formed from the precursors that would be used to form a monolayer, e.g., tridecafluoro-1,1,2,2-tetrahydrooctyltrichlorosilane (FOTS) and 1H,1H,2H,2H-perfluorodecyltrichlorosilane (FDTS).

Figure 3E:
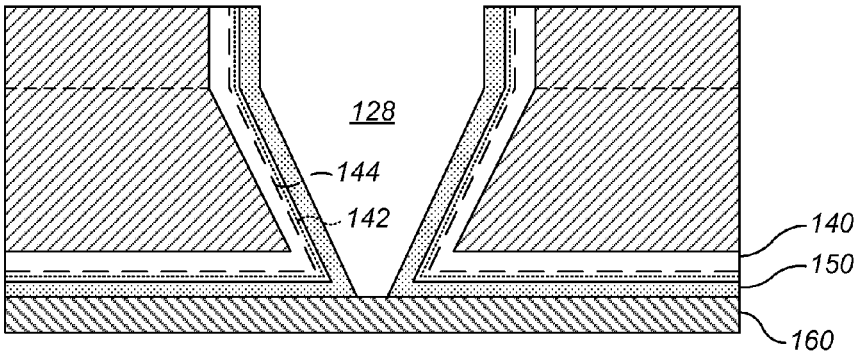

Referring to FIG. 3E, a mask 160 is applied to an outer surface of the fluid ejector, e.g., at least a region surrounding nozzle 128. The masking layer may be formed from various materials. For example, tape, wax, or photoresist can be used as a mask. Mask 160 protects the surface onto which it is applied from removal or damage resulting during a cleaning step (e.g. from exposure to oxygen plasma), and/or from subsequent deposition (e.g., from deposition of an overcoat layer). Mask 160 may have sufficiently low adhesion so that it may be removed without removing or damaging or otherwise materially altering non-wetting coating 150 beneath it.

Figure 3F:
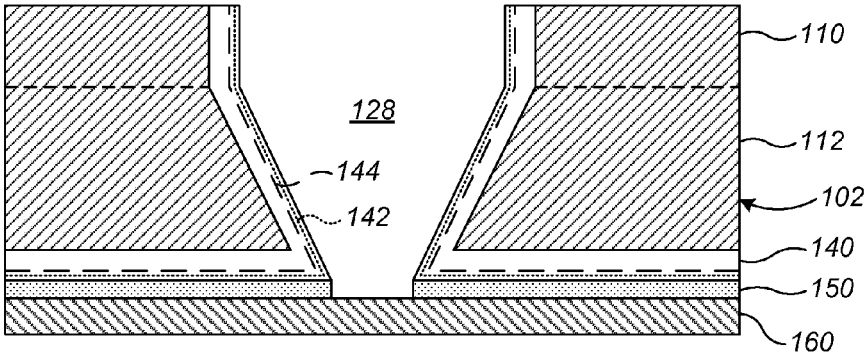

Referring to FIG. 3F, the interior surfaces of the fluid ejector in the fluid path 104 are subjected to a cleaning step, for example a cleaning gas, e.g., an oxygen plasma treatment, that removes a portion of the non-wetting coating that is not covered by mask 160. The oxygen plasma can be applied to a substrate inside a chamber, or the source of oxygen plasma can be connected to the inlet of the fluid path. In the former case, the mask 160 prevents the oxygen plasma in the chamber on the outside of the fluid ejector from removing the non-wetting coating on the exterior surface. In the later case, the mask 160 prevents the oxygen plasma from escaping through the orifices (and in this case, the mask need only cover the orifices themselves) and removing the non-wetting coating on the exterior surface.

Figure 3G:
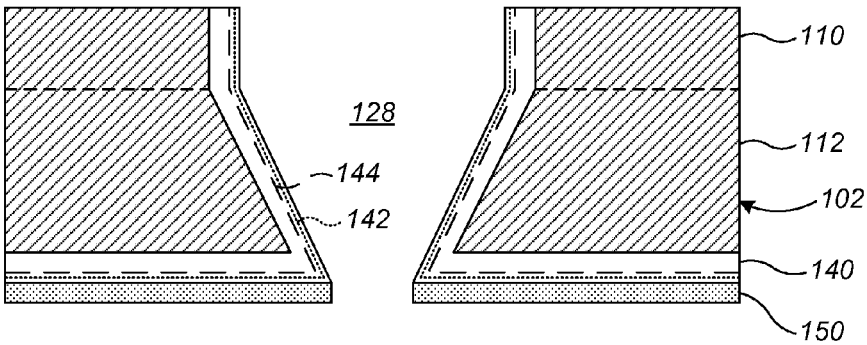

Referring to FIG. 3G, following the cleaning step, the mask 160 is removed, to provide the fluid ejector as shown in FIGS. 1A and 1B. The final completed device is a fluid ejector with exterior surfaces that are non-wetting, and interior surfaces that are more wetting than the non-wetting surfaces.

In an exemplary process, the silicon oxide seed layer is deposited with a two-step process in which the second step is at a higher partial pressure ratio of $H_2O:SiCl_4$ than the first step, e.g., with the second step at a partial pressure ratio $H_2O:SiCl_4$ greater than 2:1. The seed layer on both the interior and exterior surfaces of the fluid ejector is then subjected to oxygen plasma treatment. The non-wetting coating is formed as a molecular aggregation on both the interior and exterior surfaces of the fluid ejector, and the interior surfaces are subjected to a further oxygen plasma treatment to remove the non-wetting coating from the interior surfaces, leaving the molecular aggregation on the exterior surface.

In another exemplary process, the silicon oxide seed layer is deposited with a single-step process with the second step at a "moderate" partial pressure ratio $H_2O:SiCl_4$, e.g., about equal to 2:1. The seed layer on both the interior and exterior surfaces of the fluid ejector is then subjected to oxygen plasma treatment. The non-wetting coating is formed as a monolayer, i.e., a single molecular layer, on both the interior and exterior surfaces of the fluid ejector, and the interior surfaces are subjected to a further oxygen plasma treatment to remove the non-wetting coating from the interior surfaces, leaving the non-wetting coating monolayer on the exterior surface.

Figure 4:
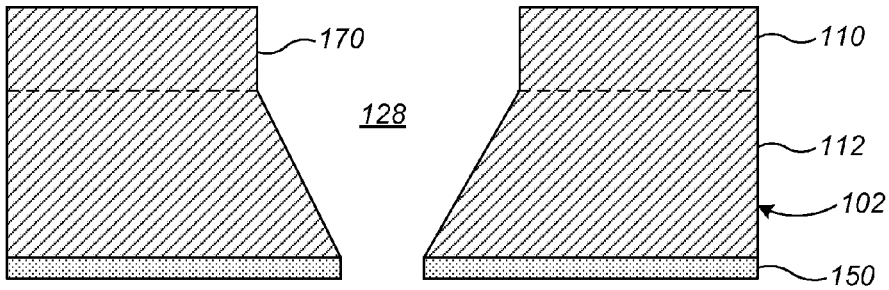
FIG. 4 is a cross-sectional view of a nozzle in another exemplary fluid ejector that does not includes a seed layer for the non-wetting coating.

In another implementation, as shown in FIG. 4, the fluid ejector 110 does not include a deposited seed layer 140, and the non-wetting coating 150 is a molecular aggregation applied directly to the native surfaces of the fluid ejector (which might include a native oxide).

Figure 5A:
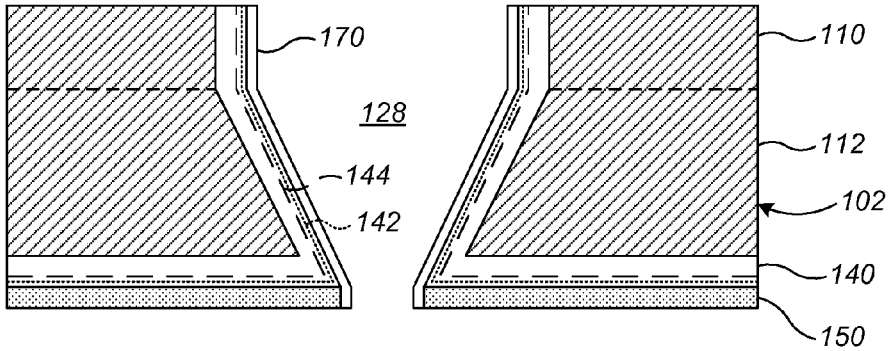
FIG. 5A is a cross-sectional view of a nozzle in another exemplary fluid ejector that includes an overcoat layer.

Referring to FIG. 5A, an overcoat layer 170 can be deposited on the inner surfaces of the fluid ejector, e.g., on the surfaces of the seed layer 140 that provide the fluid path, but not on the outer surface of the non-wetting coating 150.

First, the cleaning step may not be completely effective in removing the non-wetting coating from the interior surface, particular in the region of the nozzles. However, the cleaning step is sufficiently effective that the subsequently deposited overcoat layer will adhere and cover the non-wetting that remains on the interior surface of the fluid ejector. Without being limited to any particular theory, the interior surface might be left with patches or regions of non-wetting coating and other patches or regions of exposed seed layer that are sufficiently large to permit adhesion of the overcoat layer, or the non-wetting on the interior surface might be damaged to permit adhesion of the overcoat layer.

Second, even if the cleaning step is sufficiently effective that the non-wetting coating 150 is completely removed from interior surfaces, if an outer portion of the seed layer 140 is deposited at high water vapor partial pressure, the surface of the outer portion of the inorganic layer 140 can have a higher concentration of —OH groups at the surface, which can make the inorganic layer more vulnerable to chemical attack by some liquids.

Figure 5B:
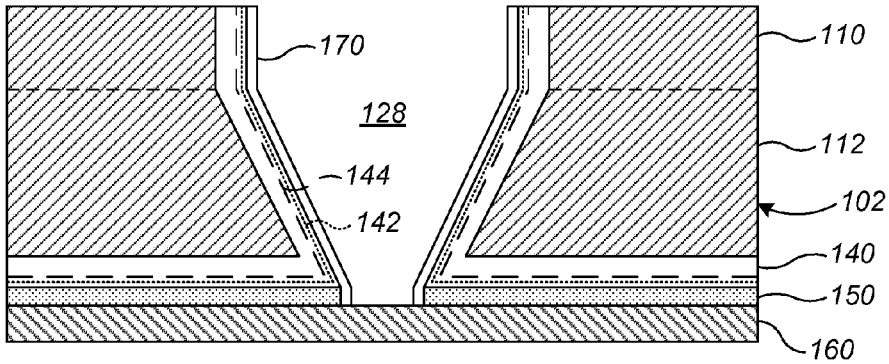
FIG. 5B illustrates a step in an exemplary process for forming the fluid ejector shown in FIG. 5A.

Fabrication of the fluid ejector as shown in FIG. 5A can proceed as discussed above with respect to FIGS. 3A-3F. However, referring to FIG. 5B, before the mask 160 is removed, the overcoat layer 170 is deposited on the exposed, e.g., unmasked, inner surfaces of the fluid ejector. After the overcoat layer 170 is deposited, the mask 160 can be removed. However, in some implementations, the material of the non-wetting coating can be such that the overcoat layer does not adhere to the non-wetting coating 150 during deposition (thus, the mask can be removed before deposition of overcoat layer, but the overcoat layer will not adhere to and not be formed on the non-wetting coating 150).

The overcoat layer 170 provides an exposed surface, e.g., in the interior of the completed device, that is more wetting than the non-wetting coating 150. In some implementations, overcoat layer 170 is formed from an inorganic oxide. For example, the inorganic oxide can include silicon, e.g., the inorganic oxide may be $SiO_2$. Overcoat layer 170 can be deposited by conventional means, such as CVD as discussed above. As noted above, a cleaning step, e.g., oxygen plasma, can be used to remove the non-wetting coating from the inner surfaces of the fluid ejector so that the overcoat layer will adhere to the inner surface. In addition, the same apparatus can be used to both clean surfaces to be deposited and to deposit the overcoat layer.

In some implementations, the overcoat layer 170 is deposited under the same conditions and have basically the same material properties, e.g., the same wettability, as the seed layer 140. The overcoat layer 170 can be thinner than the seed layer 140.

In some implementations, the overcoat layer 170 is deposited under different conditions and has different material properties from the seed layer 140. In particular, the overcoat layer 170 can be deposited at a higher temperature or a lower water vapor pressure than the seed layer 140. Thus, the surface of overcoat layer 170 can have a lower —OH concentration than surface of the seed layer 140. Thus, the overcoat layer should be less subject to chemical attack by the liquid being ejected.

In some implementation, the overcoat layer 170 can also coat exposed surfaces of mask 160, e.g., exposed interior and exterior surfaces. For instance, the fluid ejector 100 with mask attached can be placed in a CVD reactor into which precursors to overcoat layer 170, e.g. $SiCl_4$ and water vapor, are introduced. In such an implementation, the overcoat layer is formed on the exterior surface of the mask and the portion of the interior surface spanning the nozzle. The overcoat layers on the mask are then removed when the mask is removed from non-wetting coating 150.

In alternative implementations, the overcoat layer 170 does not coat the exposed exterior surface of mask 160, either because overcoat layer 170 is deposited only on interior surfaces, (e.g., the portion of the interior surface spanning the aperture) or because the overcoat layer does not physically adhere to the mask. The former case can be accomplished, for example, by equipping fluid ejector 100 with a suitable attachment so that precursors to overcoat layer 170 (e.g. $SiCl_4$ and water vapor) are introduced only to interior exposed surfaces of the fluid ejector (i.e. surfaces that will contact fluid to be ejected from the fluid ejector). In these implementations, mask 160 may be applied to a sufficiently localized region surrounding nozzles 128 to prevent the overcoat layer from reaching exterior surface regions.

Optionally, following deposition of the overcoat layer 170, the overcoat layer 140 can be subjected to an oxygen $O_2$ plasma treatment step. In particular, the inner surfaces of the overcoat layer 170 are exposed to the $O_2$ plasma. Without being limited to any particular theory, the $O_2$ plasma treatment can densify the outer portion of the overcoat layer 170. The oxygen plasma can be applied to the substrate inside a different chamber, e.g., with anode coupling plasma, than the one used to deposit the $SiO_2$ layer.

In an exemplary process, the seed layer 140 is deposited at a higher partial pressure ratio of $H_2O$:$SiCl_4$, e.g., at a higher partial pressure of $H_2O$, than the overcoat layer 170, but both the seed layer 140 and the overcoat layer 170 are subject to $O_2$ plasma treatment.

In summary, in the final product, surfaces surrounding nozzle 128 (e.g., exterior surfaces) are non-wetting, and surfaces contacting fluid to be ejected (e.g., interior surfaces) are more wetting than surfaces coated with the non-wetting coating.

A number of implementations have been described. For example, the nozzle layer can be a different material than the flow-path body, and the membrane layer can similarly be a different material than the flow-path body. The inorganic seed layer can be sputtered rather than deposited by CVD. It will be understood that various other modifications may be made without departing from the spirit and scope of the invention.

What is claimed is:

1. A fluid ejector, comprising:

a substrate having an exterior surface and an interior surface defining a flow path for fluid to an orifice in the exterior surface;

an inorganic seed layer covering the interior surface and the exterior surface of the substrate, the inorganic seed layer having different composition than the substrate and comprising water molecules trapped in an inorganic matrix, the inorganic seed layer including an inner portion and an outer portion farther from the substrate than the inner portion, the outer portion having a higher concentration of water molecules than the inner portion; and a non-wetting coating covering at least a portion of the exterior surface and substantially absent from the flow path, wherein the non-wetting coating is formed of a molecular aggregation disposed directly on the inorganic seed layer.

2. The fluid ejector of claim 1, wherein the substrate is formed of single crystal silicon and the inorganic seed layer is silicon oxide.

3. The fluid ejector of claim 1, wherein the non-wetting coating includes molecules that have a carbon chain terminated at one end with a —$CF_3$ group.

4. The fluid ejector of claim 3, wherein the non-wetting coating includes molecules formed from at least one precursor from the group consisting of tridecafluoro 1,1,2,2 tetrahydrooctyltrichlorosilane (FOTS) and 1H,1H,2H,2H perfluorodecyl-trichlorosilane (FDTS).

5. The fluid ejector of claim 1, wherein the non-wetting coating has a thickness between 50 and 1000 Angstroms.

6. The fluid ejector of claim 1, wherein the non-wetting coating includes a plurality of identical molecules held in the molecular aggregation substantially by intermolecular forces and substantially without chemical bonds.

7. A method of forming a non-wetting coating on a fluid ejector, comprising the steps of:

depositing an inorganic seed layer on an exterior surface and an interior surface of a substrate, the interior surface of the substrate defining a flow path for fluid to an orifice in the exterior surface, the inorganic seed layer having different composition than the substrate and comprising water molecules trapped in an inorganic matrix, the inorganic seed layer including an inner portion and an outer portion farther from the substrate than the inner portion, the outer portion having a higher concentration of water molecules than the inner portion;

then applying an oxygen plasma to the inorganic seed layer on the exterior surface; and then depositing a non-wetting coating directly on the inorganic seed layer on the exterior surface, wherein the non-wetting coating is a molecular aggregation and substantially absent from the flow path, wherein the step of depositing the inorganic seed layer comprises the steps of:

depositing the inner portion of the inorganic seed layer on the substrate at a first ratio of partial pressure of water to partial pressure of matrix precursor; and then depositing the outer portion of the inorganic seed layer on the inner portion at a second ratio of partial pressure of water to partial pressure of matrix precursor that is higher than the first ratio.

8. The method of claim 7, further comprising the step of holding the substrate in a chamber at a first temperature, wherein the step of depositing the non-wetting coating comprises the step of flowing a precursor of the non-wetting coating into the chamber at a second temperature higher than the first temperature.

9. The method of claim 7, wherein the inorganic seed layer includes silicon dioxide.

10. The method of claim 9, wherein the substrate is single-crystal silicon.

11. The method of claim 9, wherein the non-wetting coating includes a siloxane that chemically bonds to the inorganic seed layer.

12. The method of claim 7, wherein the matrix precursor includes $SiCl_4$.

13. The method of claim 12, wherein the second ratio of partial pressure of water to partial pressure of matrix precursor is more than 2:1.

14. The method of claim 12, wherein the first ratio of partial pressure of water to partial pressure of matrix precursor is less than 2:1.

* * * * *